US005895112A

United States Patent [19]

Olivit et al.

[11] Patent Number: 5,895,112

[45] Date of Patent: Apr. 20, 1999

[54] BI-SIDED FLASHLIGHT AND METHOD

[75] Inventors: Keith H. Olivit, Oldsmar; Michael Gingrich, Seminole; Miro S. Cater, Daytona Beach, all of Fla.

[73] Assignee: Adva-Lite, Inc., Largo, Fla.

[21] Appl. No.: 08/942,024

[22] Filed: Oct. 1, 1997

[51] Int. Cl.[6] ..... F21L 7/00

[52] U.S. Cl. ..... 362/189; 362/205; 362/208; 362/116

[58] Field of Search ..... 362/189, 116, 362/202, 205, 207, 208, 806

[56] References Cited

U.S. PATENT DOCUMENTS

| | | | |
|---|---|---|---|
| 2,879,381 | 3/1959 | Coffey | 362/189 |
| 4,032,773 | 6/1977 | Halliday, Jr. et al. | 362/189 |
| 4,210,953 | 7/1980 | Stone | 362/189 |
| 4,242,724 | 12/1980 | Stone | 362/189 |
| 4,739,455 | 4/1988 | Pullman | 362/189 |
| 5,299,108 | 3/1994 | Griffin | 362/189 |
| 5,660,458 | 8/1997 | Chabria | 362/189 |

*Primary Examiner*—Thomas M. Sember
*Attorney, Agent, or Firm*—Jack E. Dominik

[57] ABSTRACT

Disclosed is the development of a miniaturized flashlight which includes a top, and bottom, each of which is snap-fittingly secured to the other and joined by a further element, a flexible tubular housing member. The tubular member is desirably of an elliptical cross-section, but can be rectangular and multi-sided. The top and bottom are proportionally adapted to accept the cross-section of the tubular housing. A battery bridge is provided at the bottom of the bottom portion along with upstanding battery separators to thereby physically separate two batteries while electrically puting them in partial series contact. The top is adapted to fit over and ride upon the tubular member. The top has a separate electronic bridge at its upper portion for permanently engaging one battery, and leaf spring for selectively electrically engaging the adjacent bulb base above the other battery to thereby activate the circuit to illuminate the light bulb located in the top. The method addresses itself to providing a plurality of bottoms, tops, tubular members, batteries, light bulbs, and billboards all of which can be assembled by first inserting the batteries and then positioning the paper billboard interiorly of the tubular member. Thereafter the top is secured to the bottom. The top secures the contact switch in place so that it permanently contacts one battery adjacent the point where secured, and the leaf springs of the contact switch are yieldably engageable with the lower portion of the light bulb.

11 Claims, 7 Drawing Sheets

BI-SIDED FLASHLIGHT AND METHOD

BACKGROUND OF THE INVENTION

The present invention relates to flashlights. More particularly it relates to flashlights which are small in size, and very often adapted to hold keys or other goods which are desirably illuminated after dark.

FIELD OF THE INVENTION

Flashlights of the type contemplated by the present invention normally have a flexible tubular side, an enclosed battery assembly, and a light bulb. They all have a top with a light bulb, and a bottom to secure the batteries in place. Quite often such flashlights are used as give-aways by various institutions and organizations, and as a consequence internally there is a "billboard" which is visible through the tubular flexible side giving a message from its sponsor. Many of the subject flashlights are exemplified by U.S. Pat. Nos. Des. 361,333; 5,289,917; 5,124,898; 4,644,451; 4,628,418; and 4,032,773. One of the problems with the subject prior-art flashlight of U.S. Pat. No. 4,644,451 is that of removal and replacement of the batteries or light bulbs or message. The battery of the subject patent is difficult to replace, and even more so the light bulb. The claims specifically recite that the light bulb is connected to two wires. In addition provision for removal of the battery is not maintained. Also with the subject prior-art patent, the illumination can only be accommodated by pressing one side. Since the flashlight is intended for use in the dark, it is difficult for the user to determine which is the side to activate. Necessarily a unit which is activated from either side is a solution to that problem. Indeed, if the user presses the wrong side of the flashlight, or becomes confused, the illumination aspect is rendered uncertain. Oftentimes it is difficult to remove and replace batteries without destroying the flashlight. A secondary problem arises from the fact that the light bulb may not be readily replaceable. Yet another problem arises from the fact that the flashlight of the above-identified patents require pressing on one side in order to activate the flashlight. If the user presses the wrong side of the flashlight, or becomes confused, the illumination aspect is the subject of uncertainty. The existing flashlights are not readily susceptible of modularization so that the bottom, top, tubular portion, battery, billboard, and top with light can be shipped to remote locations for assembly. In addition, they cannot be readily disassembled to change the billboard message. Moreover, they cannot be shipped to the customer readily where the customer has several billboard messages, and may wish to apply them sequentially in small lots. Additionally, the subject prior-art patent utilizes a connection from battery-to-battery to close the circuit. The connection is specifically from the negative side of the first battery which is beneath the light bulb, to the positive side of the right battery or second battery which is remote from the light bulb. This results in inhibiting the ability of securing the batteries against dislodgement by means of pressing from the top and the bottom, since the bottom portion of the batteries involves the switching assembly.

SUMMARY OF THE INVENTION

The present invention derives from the development of a miniaturized flashlight which includes a top, and bottom, each of which is snap-fittingly secured to the other and joined by a further element, a flexible tubular housing member. The tubular member is desirably of an elliptical cross-section, but can be rectangular and multi-sided. The top and bottom are proportionally adapted to accept the cross-section of the tubular housing. A battery bridge is provided at the bottom of the bottom portion along with upstanding battery separators to thereby physically separate two batteries while electrically putting them in partial series contact. In this fashion the battery bridge serves the twofold function of electrically connecting the two adjacent batteries at their lower portion, and yieldably urging them upwardly to firmly lodge them inside the housing. The top is adapted to fit over and ride upon the tubular member. The top has a separate electronic bridge at its upper portion for permanently engaging one battery, and leaf spring for selectively electrically engaging the adjacent bulb above the other battery to thereby activate the circuit to illuminate the light bulb located in the top. In this fashion the desired end result is to permit both batteries to either have a shielded case, or an unshielded case which is negative. With the prior art, a modification is required in the switching means when transferring from one type battery to the other. By practicing the present invention, this undesirable feature is eliminated and actually two batteries can be comingled, one of which has an insulated case, and the other of which does not. The method addresses itself to providing a plurality of bottoms, tops, tubular members, batteries, light bulbs, and billboards all of which can be assembled by first inserting the batteries and then positioning the paper billboard interiorly of the tubular member. Thereafter the top is secured to the bottom. The top secures the contact switch in place so that it permanently contacts one battery adjacent the point where secured, and the leaf springs of the contact switch are yieldably engageable with the lower portion of the light bulb. Thus by adopting the method, a wide variety of parts can be manufactured and held in storage, including tops and bottoms of varying colors, awaiting only an order which can be filled by a specialized billboard, fresh batteries, and a fresh light bulb which is normally a lens light. A lens light normally includes its own lens at the end opposite the bulb base where the electrical contact is made.

In view of the foregoing it is a principal object of the present invention to provide a miniature flashlight conveying a message which can be adapted for holding useful items such as a key which is assembled from parts which can be, in turn, easily disassembled to change batteries, light bulb, or message.

Another object of the present invention is to provide a miniature flashlight for use with a key or other accessory in which both the battery and the light are easily replaceable by the end user, and the same will accommodate a triple A battery "AAA" plus lens light of two and one half volts which are all readily available and require no special order. Exemplary is a bulb No. 222 with a screw base and pre-focused high intensity lens.

Yet another object of the present invention is to provide a flashlight for an accessory which can be activated by squeezing from either one side, the other side, or both sides. This avoids the ambiguity of a single-sided illuminated flashlight where the user, in confusion in the dark, may be delayed in illuminating the light at a time when prompt illumination and activation of the key is warranted.

Yet another object of the present invention is to provide a flashlight of the type described the method for manufacture of which is inherently efficient and can be achieved without special purpose tooling, and particularly at remote locations or indeed, by the ultimate user.

A further objective of the present invention is to provide a flashlight with all of the advantages set forth above in which the billboard can be removed, or which permits the customer to have several billboards which the customer himself may develop to insert inside the flashlight.

Finally, but not the last object of the present invention, is to achieve all of the above advantages in a construction, the inherent cost of which is very competitive with other flashlights which afford two of the above advantages.

DESCRIPTION OF ILLUSTRATIVE DRAWINGS

Further objects and advantages of the present invention will become apparent in the following description of an illustrative embodiment proceeds, taken in conjunction with the accompanying drawings in which.

DESCRIPTION OF A PREFERRED EMBODIMENT

Figure 1:
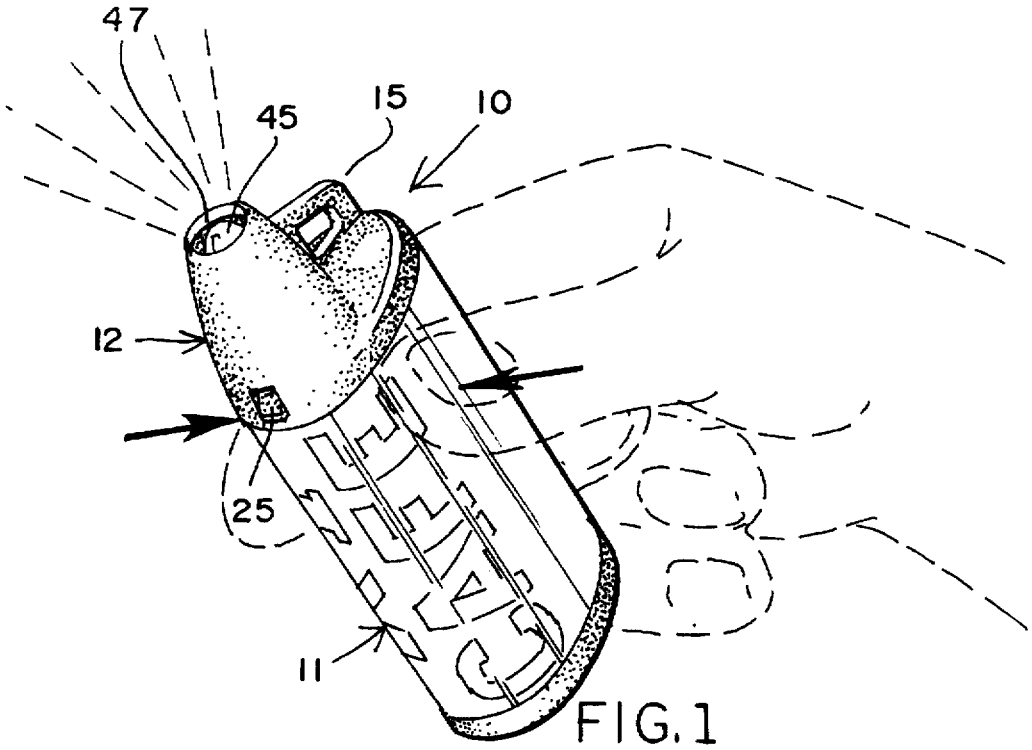
FIG. 1 is a perspective view of the subject flashlight showing in phantom lines and of an operator squeezing the sides to activate the light.
Figure 2:
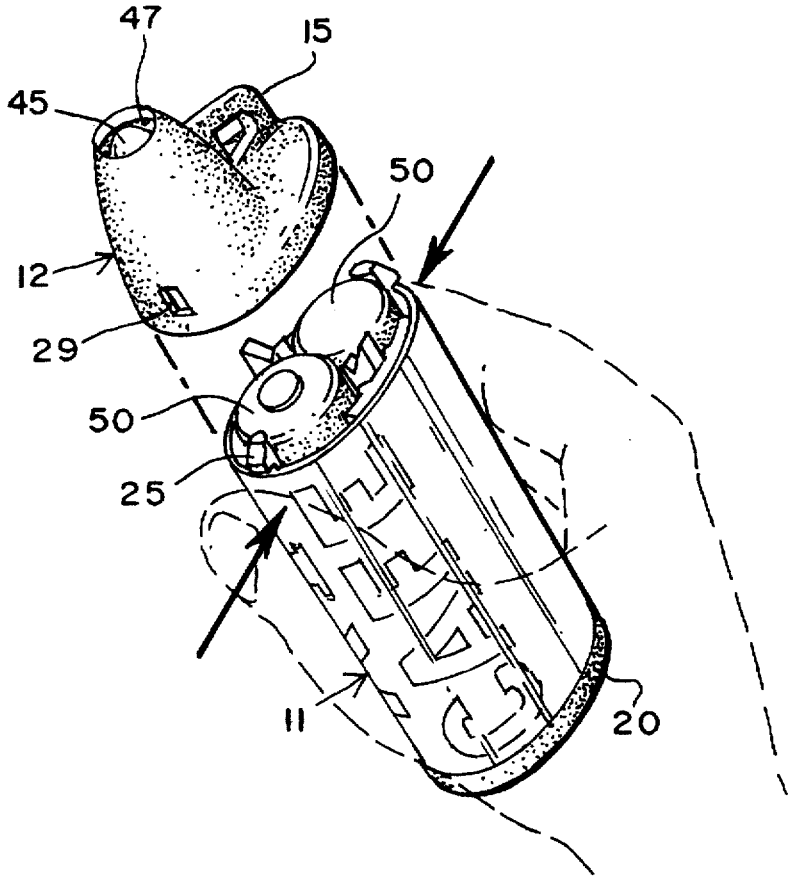
FIG. 2 is a perspective view from the same vantage point as FIG. 1 showing how the hand of the user when rotated 90° around the flashlight can squeeze along the major axis of the elliptical body and release the top for removal and replacement of the batteries and the light.

The bi-sided flashlight 10 illustrative of the present invention is shown in FIG. 1 being activated by squeezing the opposite sides of the flashlight. Similarly, in FIG. 2, the bi-sided flashlight 10 is being shown as opened for removal of the top 12, batteries 50, and light bulb 45 (not shown).

Figure 3:
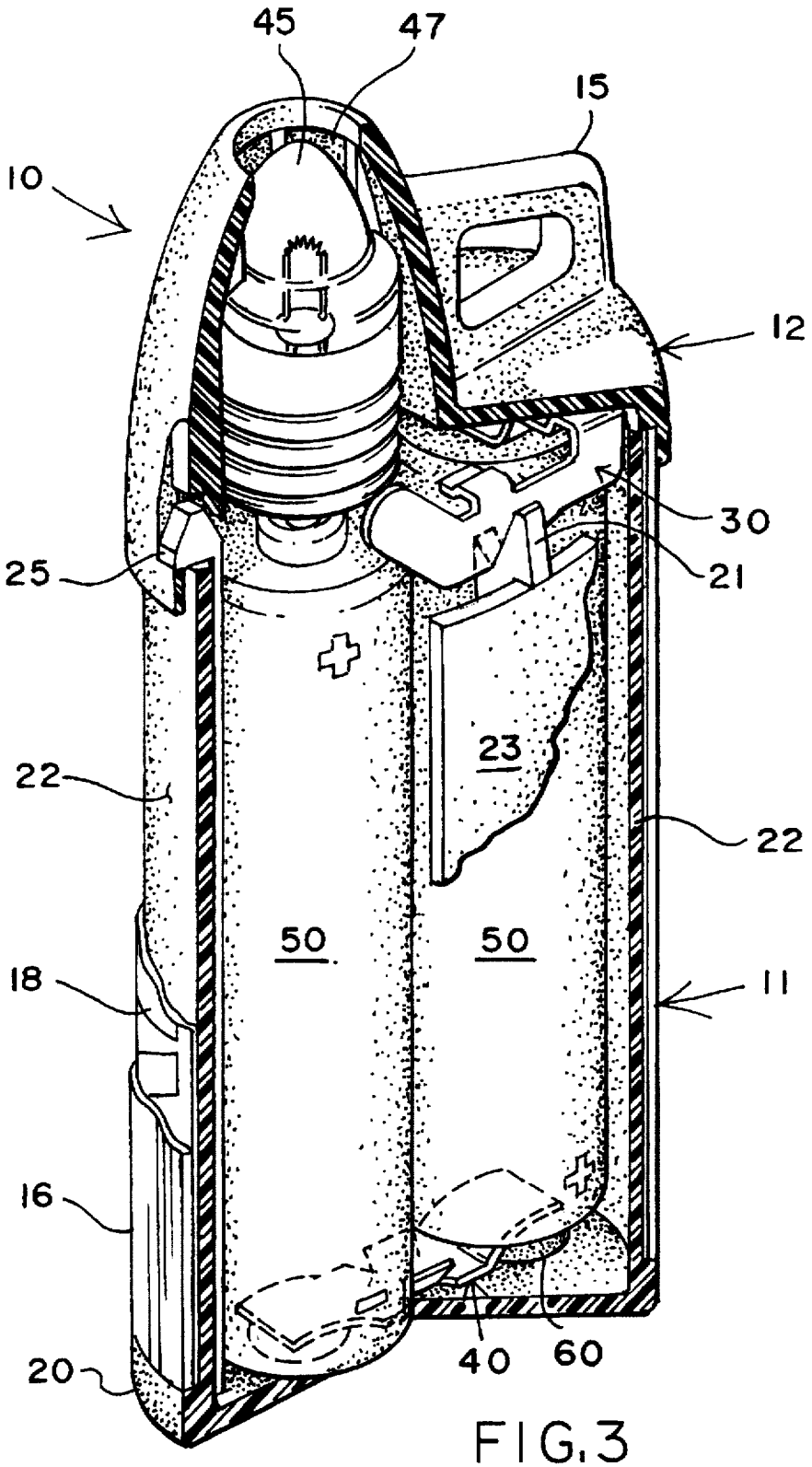
FIG. 3 is an enlarged perspective broken view showing the interior portion of the flashlight illustrating the location of the two batteries, the lens light, and the activating contact for the switch.

Proceeding to FIG. 3, it will be seen that the bi-sided light 10 has a housing 11 which is normally a transparent and flexible tubular member, desirably with an elliptical cross-section. A top 12 is provided to sit on top of the housing 11. The top 12, in turn, has a holder closed loop 15 to which a key chain or other object personal to the owner may be secured.

An aperture 43 is provided above the top 12 laterally disposed from the closed loop 15. In this fashion a key chain or other object which is secured to the holder will be immediately adjacent to the aperture 43 and the bulb 45 therebeneath. As a consequence, when the bulb is illuminated a target area will be illuminated which is immediately adjacent the holder 15. For example, if the key is to be inserted into a key hole, the light is conveniently placed on the hey hole.

Consistent with the invention, a billboard 18, normally opaque with printed indicia on it, is positioned immediately interior of the elliptical housing 11. Since the housing 11 is transparent, it therefore permits viewing of the entirety of the message on the billboard 18.

The bottom 20 closes the lower end of the housing 11. In addition, however, extending upwardly from the bottom in opposed relationship are the contact drives 21. These both are of beam construction and sufficiently flexible in nature that they can cause the on and off illumination of the light bulb 45. At ninety degree spacing to the contact drive 21 are the opposed release locks 22. Upon squeezing the opposed release locks 22, the top lock 25 is disengaged from the top lock latch 29, and then the top 12 can be removed. The contact drives 21 and separators 22 are both provided with lateral curvilinear webs 23, 27 to strengthen the drives 21 and separators 22 as well as add further support and shape to the billboard 18.

Figure 4:
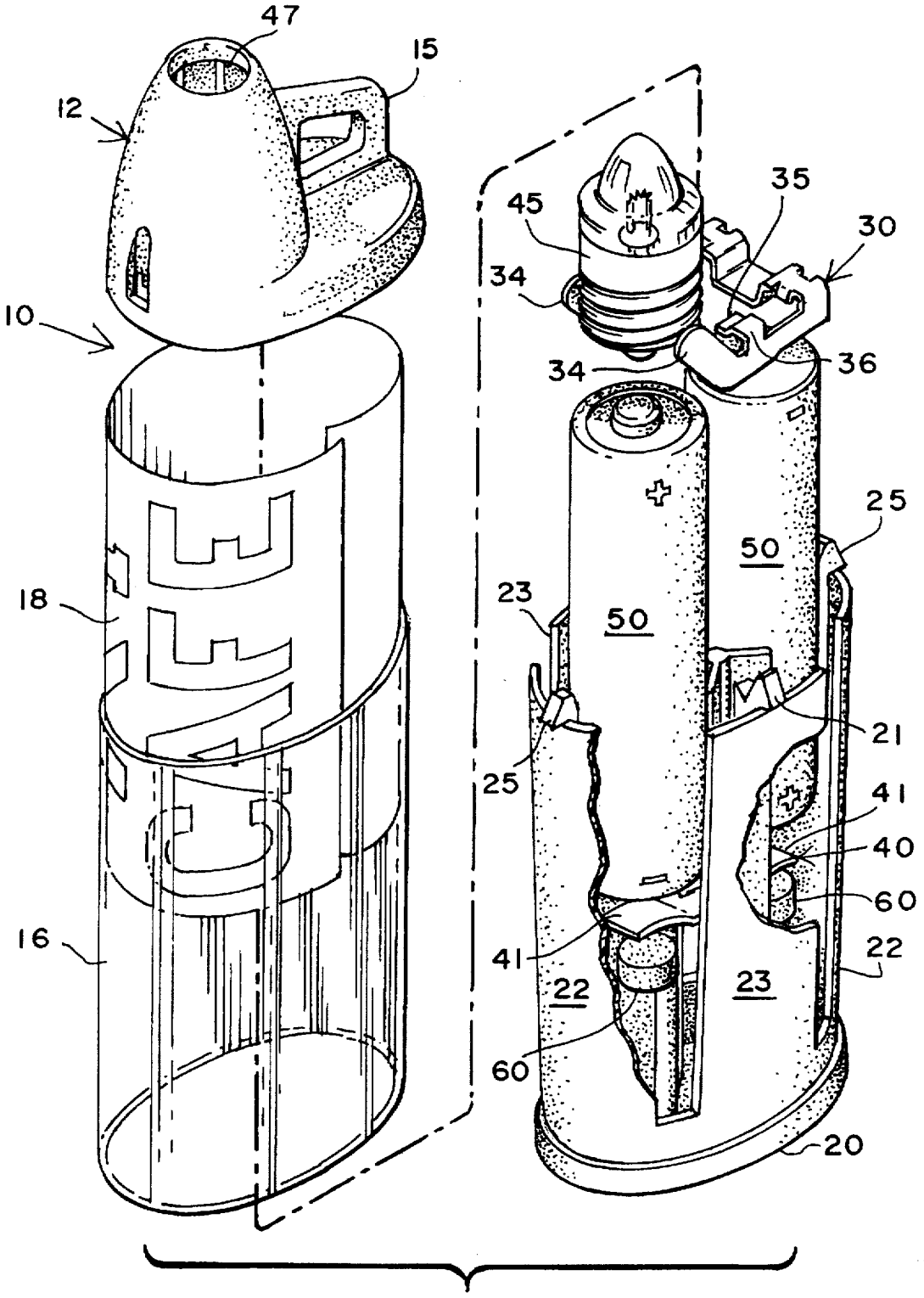
FIG. 4 is a further exploded perspective view showing the sequence of top, billboard, transparent body, removable lens light bulb, batteries, and bottom.
Figure 5:
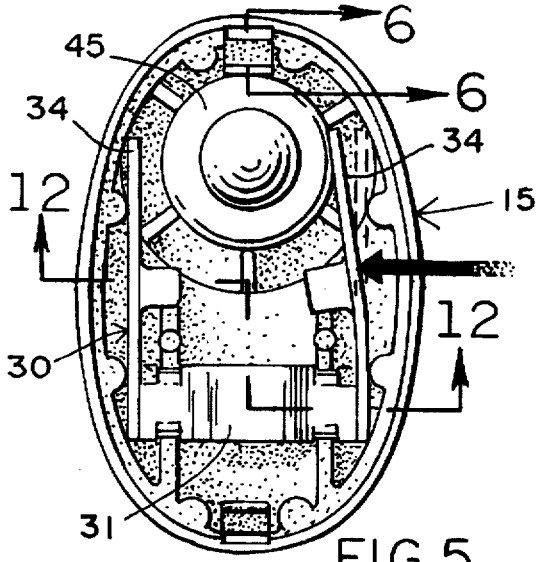
FIG. 5 is a transverse sectional view cut through the top on section line 5—5 of FIG. 3 but in smaller scale.
Figure 6:
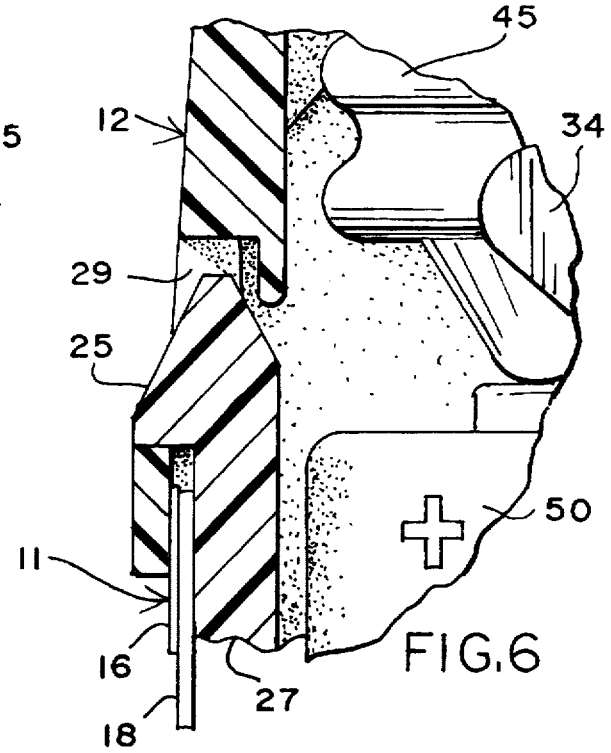
FIG. 6 is an enlarged partial sectional view taken at 6—6 of FIG. 3.
Figure 7:
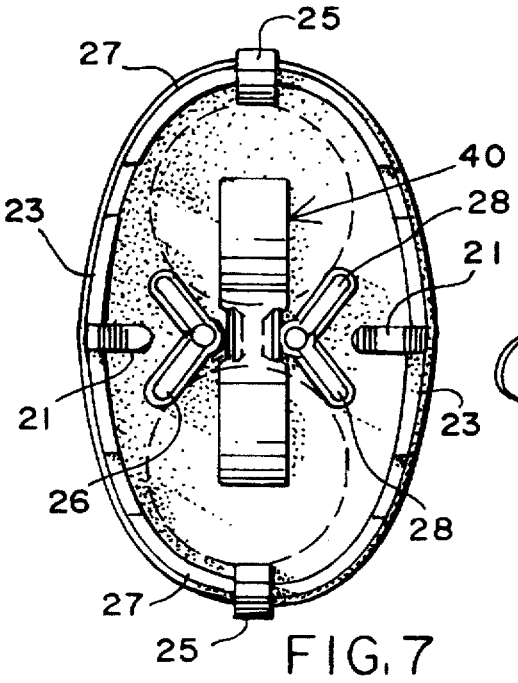
FIG. 7 is a bottom view of the unit looking upwardly from the base of the batteries.

Also extending upwardly from the bottom 20 are the battery separators 26 shown in FIGS. 4 and 7 in particular. Each of the battery separators 26 has a pair of wings 28 which tangentially engage the opposed batteries 50, particularly as shown in FIG. 7.

Figure 8:
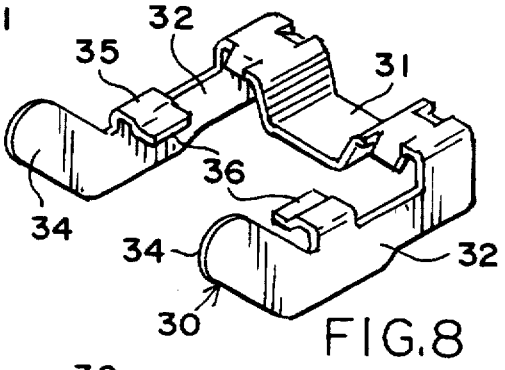
FIG. 8 is an enlarged perspective view of the contact switch shown from the top.
Figure 9:
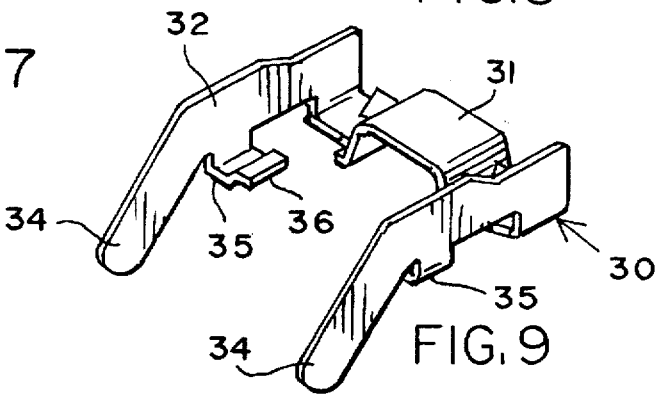
FIG. 9 is a bottom view of the contact switch in the same scale as FIG. 8.
Figure 12:
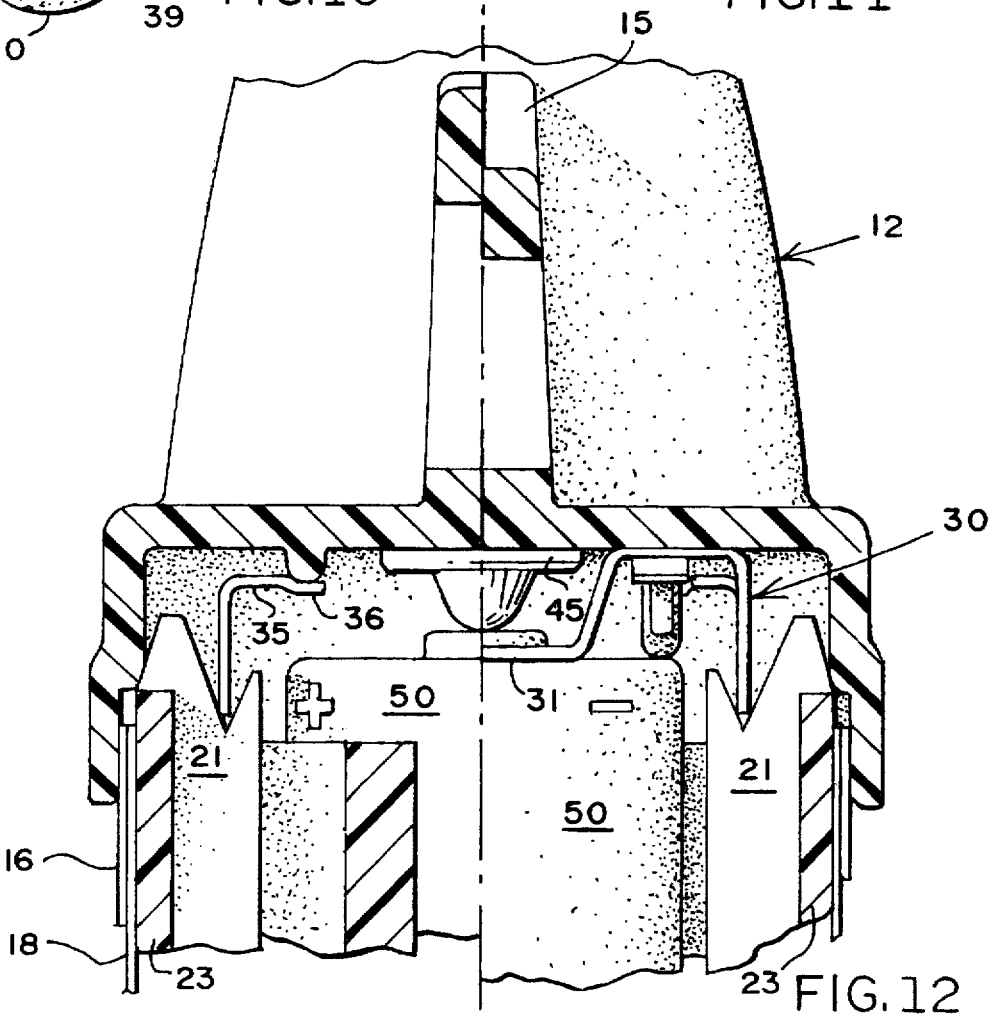
FIG. 12 is a split sectional view taken along section line 12—12 of FIG. 5 but in enlarged scale.

The contact switch 30 is positioned beneath the holder 15 of the top 12. The switch is shown in FIGS. 3 and 4 in particular. The specifics of the contact switch 30 are shown in FIGS. 8 and 9. There it will be seen that provision is made for a battery barb lock bridge 39, one face of which engages one of the batteries. Perpendicular to the battery contact bridge are leaf springs 32. At the end of leaf springs 32 and curved upwardly are the bulb base contacts 34. At a mid-position between the bulb base contact 34 and the battery contact bridge 31, a pair of opposed snaps 35 extend toward each other centrally from the leaf springs 32, and at their end provision is made for a detent 36. Barb locks 38 are provided on both extremes of the barb lock bridge 39, the purpose for which is to insert the remote ends of the battery bridge 31 into pockets 43 provided in the top whereupon the barb action of the barb lock 54 locks the contact switch 30 in place in the top 12. The snap 35 and snap detent 36 are proportioned to engage the top snap simulator 46 particularly as shown in the left-hand portion of FIG. 12. Moreover, again as shown in FIG. 12, the leaf spring 32 rides in the support crotch 55 at the upper portion of the contact drive 21 as particularly shown in FIGS. 3 and 12.

Figure 10:
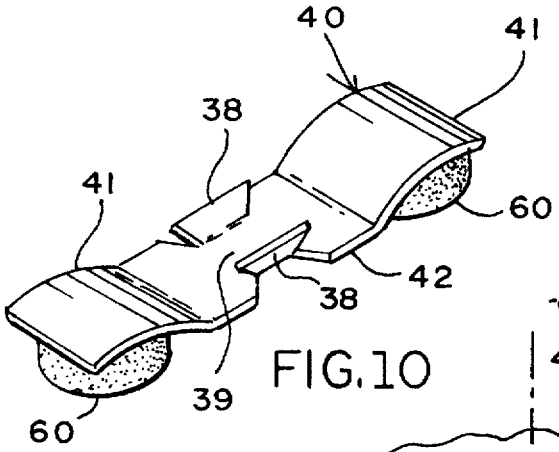
FIG. 10 is a perspective view of the battery bridge for positioning at the bottom of the unit.
Figure 11:
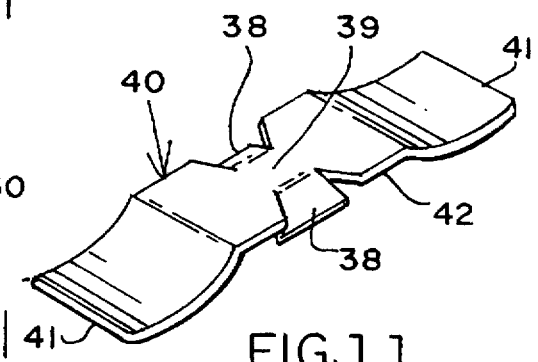
FIG. 11 is a perspective view in the same scale as the battery bridge in FIG. 10 but showing the underneath side of the same.

As shown in FIGS. 10 and 11, there is a bottom battery bridge 40 which makes contact with the opposite polarity ends of the batteries adjacent the bottom 20 of the bi-sided flashlight 10. As further shown in FIG. 10, the battery bridge 40 includes contacts 41 at its remote ends, and a base 42. Extending from the base 42 are barb locks 38 which permit the bridge 40 to be inserted into the bottom 20 for retention in much the same fashion as with the barb locks 54 on the contact switch 30.

Figure 13:
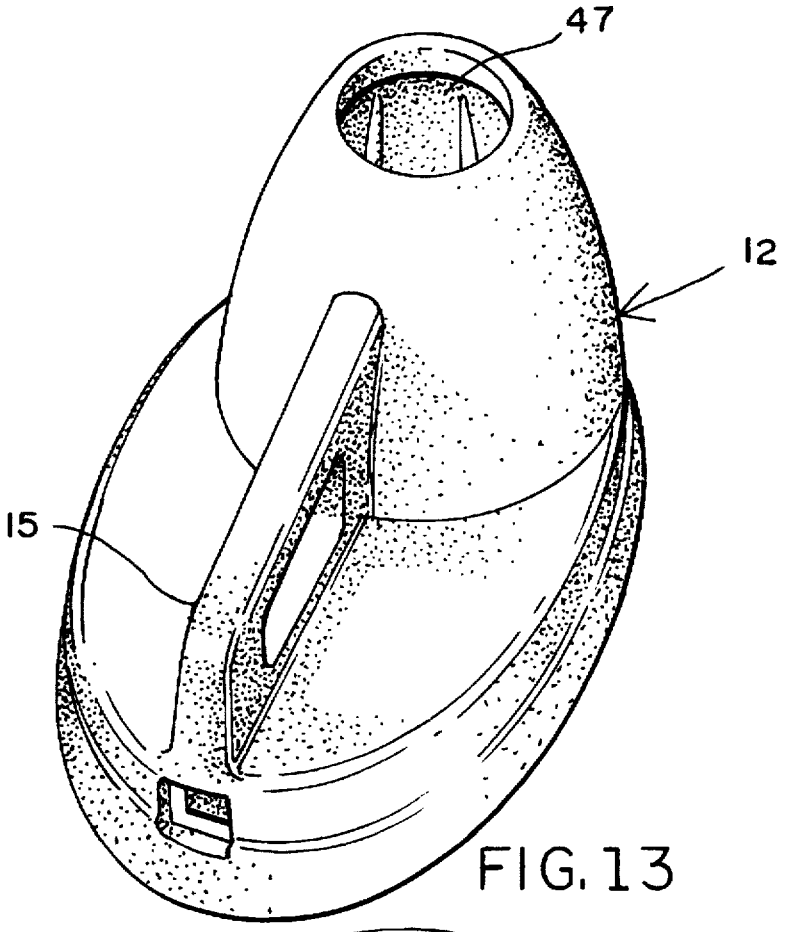
FIG. 13 is a perspective view of the top of the flashlight.
Figure 14:
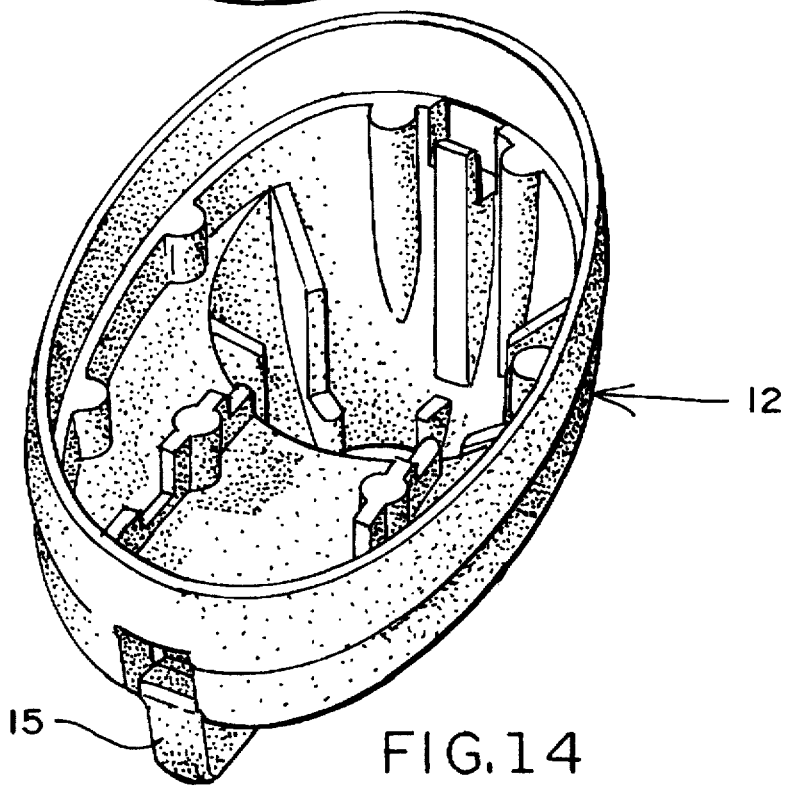
FIG. 14 is a bottom perspective view of the top shown in FIG. 13.
Figure 15:
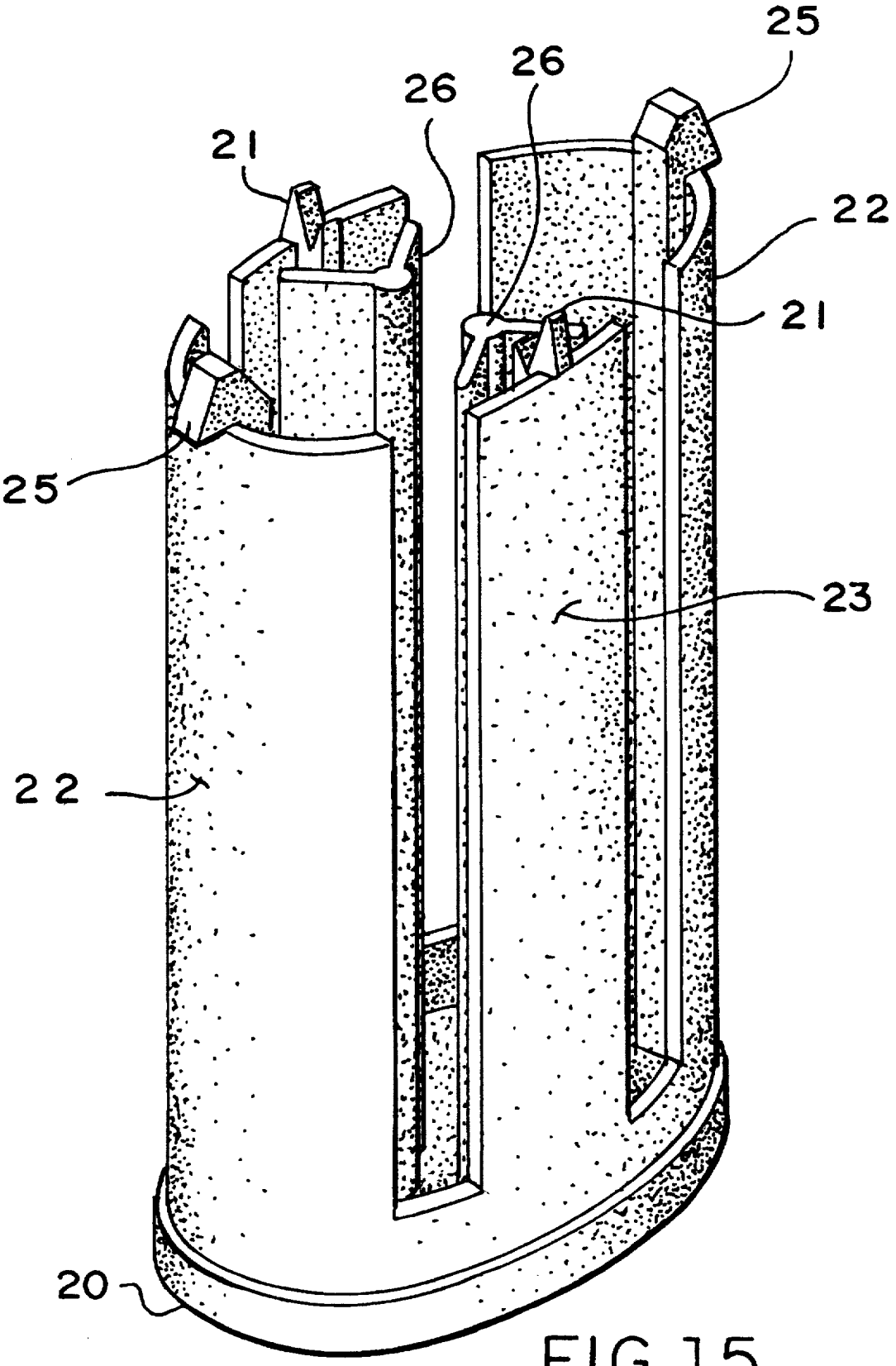
FIG. 15 is a perspective view of the bottom.

For a more complete showing of the top and the bottom, attention is directed to FIGS. 13, 14 and 15. There will be seen that the sandwich like securement of the bottom 20 and the top 12 are removed from their relationship sandwiching the billboard in place, much as set forth with regard to the description of FIG. 3.

From a review of the foregoing it becomes apparent that the entire bi-sided flashlight 10 is the product of the body portion 11, the top 12, and the bottom 20. The holder 15 having an eye in the middle is for the attachment of keys, coin holders, good luck charms, or any other accessory item which the user wishes to secure to his bi-sided flashlight 10. In the exploded view in FIG. 2 it will be seen how easily the top 12 can be removed to replace the batteries 50, and then replace the same. Turning now to FIG. 4, it will be seen in greater detail how the bi-sided flashlight 10 can be assembled from bottom to top by positioning the housing 11 on top of the bottom 20 and specifically on top of the support collar 48. Prior to this positioning, however, the billboard 18 is inserted interiorly of the housing 11. Thereafter, the batteries 50 are dropped into the bottom separated by the battery separators 26. The balance of the elements including the light bulb 45 and the contact switch 30 are housed in the top 12, and when it is placed on top the entire bi-sided flashlight 10 is completely assembled. As seen also in FIG. 12, a collar 49 is provided at the underneath portion of the top 12 to receive the upper portion of the housing 11.

The Method:

The method of the present invention relates to the development of and assembly of a bi-sided flashlight 10 which has basic components including a housing 11, a top 12, a billboard 18, and a bottom 20. These may be manufactured and stored separately or aligned in a production line for assembly of the bi-sided flashlight 10. Once the parts are provided, the sequence of assembly looks to first providing billboards 18 with the customized inscription desired by the purchaser. Thereafter, the billboard 18 is inserted inside the housing 11 and placed on top of the bottom 20. Wherever reference is made to top and bottom, or left and right, the same can be reversed 90° or 180° and the sequence remains the same.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A flashlight comprising, in combination, a top having a generally elliptical body portion terminating in lower skirt means for engagement to a tubular body member, said tubular body member terminating in lower skirt means for engagement with said tubular body member, a tubular body member, said top having light bulb removably securable engaging means, a light bulb in said removably securable engaging means, a bottom for engaging the subject tubular member, having upstanding means for removably securing batteries therein, each battery having a top and bottom, the top of the flashlight having a contact switch member with one end removably securable for constant contact with one battery, and the other end having centrally extending leaf springs for selectively engaging a light bulb and a battery top, an electrical bridge for removably engaging the bottom of the subject batteries to which the batteries are removably secured, space provided interiorly for a message billboard of the selection of the user, the top contact switch and bottom electrical bridge and their connection to the battery ends comprising a circuit to be closed when either or both top leaf springs are urged in electrical contact with said light bulb.

2. The flashlight of claim 1, in which, said tubular body member is transparent.

3. In a flashlight having a top, a bottom, a tubular member having opposed sides surrounding the area between said top and said bottom, and means for securing the top to the bottom to sandwichingly engage the tubular housing member, a pair of batteries each having a bottom and top portion, means provided for supporting said pair of batteries, an electrical bridge on the bottom member for electrically connecting the two bottom portions of the two batteries, a lens light bulb having a bottom, means for supporting a lens light bulb at a portion of the top, the improvement comprising, an electrical contact bridge for permanent securement to the top of one of the two batteries in a position opposed from the lens light bulb, said bridge having a base portion for securing to the one such battery, said base portion having a pair of leaf springs extending laterally from the base and in opposed relationship to the battery, said tubular body portion being flexible, said leaf springs being positioned laterally from the bottom of the light bulb, whereby upon squeezing one or the other side or both of the tubular member the leaf springs, either or both, are placed in contact with the base of the lens light and thereby complete the electrical contact to activate the light.

4. In the flashlight of claim 1, upstanding snap acting engaging means extending from the bottom of the flashlight to the top of the flashlight to snap actingly secure the same to each other after the batteries and light bulb are inserted, said means being formed and proportioned so that by squeezing at a midpoint transversely of the tubular body member the snap acting means are temporarily released and the top can be removed, whereby both the battery elements and the lens light element can be removed and replaced.

5. In the flashlight of claim 4 above, means for securing a billboard interiorly of the flexible body which can be inserted, or replaced, or removed at the same time as the batteries and/or bulb may be replaced or removed.

6. A bi-sided flashlight comprising, in combination, a tubular flexible body portion with opposed body sides and having body top and body bottom ends spaced from each other, a flashlight top proportioned to matingly engage the top portion of the tubular body, a flashlight bottom proportioned to engage the bottom of the tubular flexible body portion, a pair of batteries each having a battery top and a battery bottom, said flashlight bottom having upstanding battery separating means for engaging the pair of cylindrical batteries, the bottom of said flashlight body having electrical bridge means for developing a continuous circuit between the bottom of the two batteries, said flashlight top having a contact switch secured to one of said batteries and flexible leaf springs extending from the contact switch and positioned for movement toward the base of a light bulb, a light bulb positioned above one of said batteries in electrical engagement with said one battery, the light bulb having a bulb portion and a base portion, and a pair of upstanding contact drives extending upwardly from the flashlight bottom to engage the leaf springs of the contact switch, the contact drives being in contact with the tubular flexible body portion, whereby upon squeezing the tubular flexible body portion, contact can be made between at least one of th e leaf springs and the base of the light bulb, thereby closing the electrical circuit and illuminating the light bulb.

7. In the bi-sided flashlight according to claim 1, a pair of opposed upstanding members extending upwardly from the bottom and yieldable therewith, means atop the upstanding locking members for yieldable securement to the top, whereby upon squeezing the ends of the body the top can be unlocked from the body, removed therefrom, and the batteries and light bulb replaced.

8. In the bi-sided flashlight according to claim 6, said body being transparent.

9. In the bi-sided flashlight according to claim 6, space provided for inserting a billboard interiorly of the transparent body portion, whereby each such flashlight can be personalized with a personal message on the subject billboard.

10. The bi-sided flashlight according to claim 6 and further including, a pair of opposed snaps, each snap having detents and extending toward each other centrally from the leaf springs, snap and detent coupling means positioned within the flashlight top, whereby upon squeezing the tubular flexible body portion to illuminate the light bulb, a snap-acting feel is transmitted back into a hand of a user.

11. The bi-sided flashlight according to claim 6 and further comprising, a mounting ring offset laterally from the light bulb and on top of the flashlight top.

* * * * *